United States Patent [19]

Denin

[11] 3,979,040

[45] Sept. 7, 1976

[54] NAIL DRIVER

[76] Inventor: Adam Denin, P.O. Box 10021, Amarillo, Tex. 79106

[22] Filed: Sept. 22, 1975

[21] Appl. No.: 615,798

[52] U.S. Cl. ..... 227/113; 145/46; 227/147

[51] Int. Cl.[2] ..... B25C 5/06

[58] Field of Search ..... 227/113, 147; 53/343; 145/46

[56] References Cited

UNITED STATES PATENTS

| | | | |
|---|---|---|---|
| 541,038 | 6/1895 | Clark | 227/147 |
| 608,555 | 8/1898 | Nazel | 227/147 |
| 1,127,838 | 2/1915 | Willers | 227/147 |
| 1,575,582 | 3/1926 | Joy | 227/147 |
| 1,690,588 | 11/1928 | McCluney | 227/147 |
| 2,030,188 | 2/1936 | Smith | 53/343 X |
| 2,258,861 | 10/1941 | Park et al. | 227/147 |
| 2,309,548 | 1/1943 | Stover | 53/343 X |
| 3,342,228 | 9/1967 | Reid | 227/147 X |

*Primary Examiner*—Victor A. Dipalma
*Attorney, Agent, or Firm*—Wendell Coffee

[57] ABSTRACT

A tube of nonmagnetic materials has magnets mounted on one end thereof. A nail held within the tube by the magnets is driven into a work piece by a weighted rod-shaped driver telescoped within the tube.

7 Claims, 3 Drawing Figures

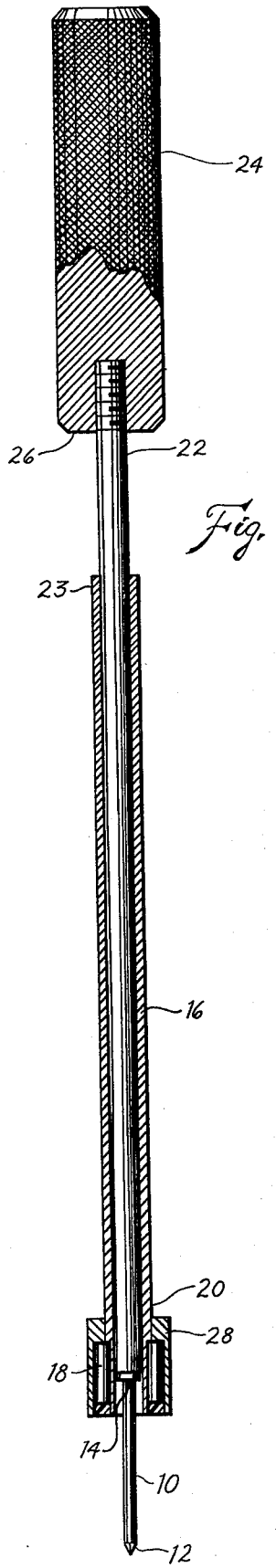
Fig. 1
Fig. 2
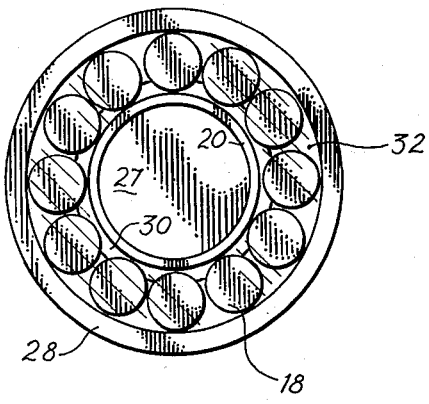
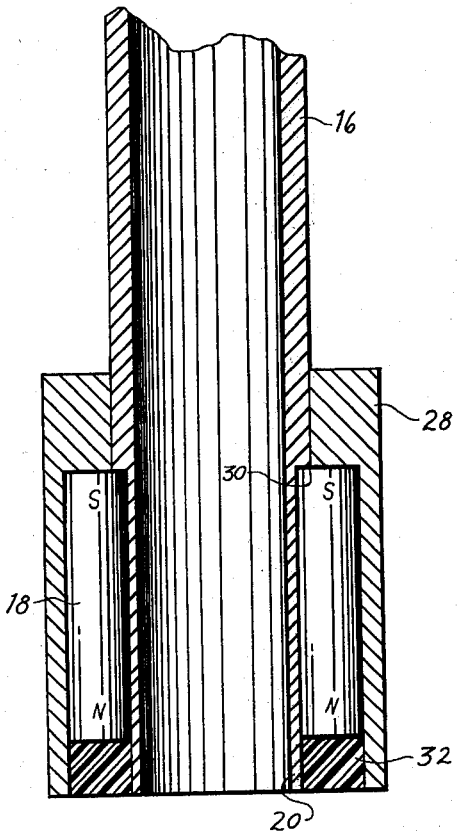
Fig. 3

NAIL DRIVER

CROSS-REFERENCE TO RELATED APPLICATIONS

None. However, by separate letter it is requested that Disclosure Document No. 041005, filed in the Patent Office on May 15, 1975, be transferred to this application according to MoPEP 1706.

BACKGROUND OF THE INVENTION

1. Field of the Invention

This invention relates to a magnetic nail holder and driver.

2. Description of the Prior Art

Nail and tack drivers have been known before this invention. Previous workers magnetized a driving rod and placed it within a tube so that a tack or nail may be driven at the point desired. Examples of such teaching is shown in the NAZEL U.S. Pat. No. 608,555 and the REID U.S. Pat. No. 3,342,228. Others have suggested holding a nail by a clip while driving it in place with a guided rod, see KENWORTHY et al. U.S. Pat. No. 3,036,482.

The applicant was familiar with the patents to CLARK, 541,038; DANZER, 620,426; WILLERS, 1,127,838; and JOY, 1,575,582, at the time of filing this patent application.

SUMMARY OF THE INVENTION

New and Different Function

I have invented a magnetic nail driver where the magnets are located on the tube and, therefore, are not subject to the jarring impact of the driving rod. Impacting a magnetized driving rod against medium or heavy nails is undesirable because most modern magnetic material is brittle. Also, impacts tend to de-magnetize the magnets. Therefore, mounting magnets made of particular material upon a tube of nonmagnetic material enables me to use a very strong magnet which holds the nail well in place, but the magnets are protected from driving blows.

With my invention it is also possible to locate the point the nail is to be driven quite precisely and hold the nail aligned while driving. Another advantage of my invention is that the driving tool may be reversed and the magnets against the handle will hold the parts together during storage and transportation.

Objects of the Invention

An object of this invention is to drive nails into a work piece.

Other objects are to achieve the above with a device that is sturdy, compact, durable, lightweight, simple, safe, efficient, versatile, and reliable, yet inexpensive and easy to manufacture, operate, and maintain.

Further objects are to achieve the above with a method that is versatile, rapid, efficient, and inexpensive, and does not require skilled people to operate, and maintain.

The specific nature of the invention, as well as other objects, uses, and advantages thereof, will clearly appear from the following description and from the accompanying drawing, the different views of which are not to the same scale.

BRIEF DESCRIPTION OF THE DRAWING

FIG. 1 is an axial sectional view of the assembled tool.

FIG. 2 is an elevational view of the magnetic end of the tube.

FIG. 3 is an enlarged axial sectional view of the magnetic end of the tube.

DESCRIPTION OF THE PREFERRED EMBODIMENT

Referring to the drawing and as stated above, the object of this invention is to drive nail 10 into a work piece (not shown). It will be understood that the work piece would normally be a wooden object such as an article of furniture, a wall, or the like. However, it will also be understood that the work piece might be otherwise, such as concrete and in that case would be a masonry nail. Also, with so many synthetic materials on the market, it might be desired to use the tool to drive a nail in some synthetic material. The nail 10 will have pointed end 12 and head 14.

The driver includes sleeve or tube 16 made of nonmagnetic material. I prever to use nonmagnetic steel as the material for the tube 16, although it will be understood that it could be made from other metals such as brass, aluminum, etc., of some nonmetalic material such as plastics. At least one and in fact a plurality of magnets 18 are attached to magnetic end 20 of the tube 16.

Rod-shaped driver 22 is telescoped within the tube 16 with a free-sliding fit. The driver can be of either a magnetic material or a nonmagnetic material. I find cold rolled steel a suitable material for the driver. The driver has weighted handle 24 on one end thereof. As it may be seen, in normal operating condition the handle 24 extends from handle end 23 of the tube 16. I find it convenient to make the driver rod and the handle of two pieces of metal and have the driver 22 attached to the handle 24 by threads; However, it will be understood that they could be made unitarily or attached in any other manner. I also find cold rolled steel a convenient material from which to make the handle 24. It has the advantage of being magnetized and, therefore, if the sleeve is reversed and placed over the driver 22, the magnets 18 will fit against shoulder 26 of the handle and hold the two parts of the tool together while being stored or transported in a tool box. Also, the magnets retain their magnetism better in such a condition. The handle 24 is knurled so it can be held securely. Also, it may be seen that the length of the driver 22 from the shoulder 26 to driving head 27 is longer than the tube 16.

To use the tool, a nail 10 is placed head first into the tube 16 at the magnetic end 20. Then the tube is positioned at the exact location desired to drive the nail. The nail is driven home by reciprocating the handle 24 within the tube 16. The impact of the driver 22 against the head 14 of the nail drives it in. It is emphasized that the nail is not pushed into the work piece, but it is driven there by the blows of the driver 22 against the head of the nail. It is the impact which results in the traditional ring of the carpenter's hammer results in a more secure fastening than merely pushing the nail into position.

I find a desirable way to hold the magnets 18 to the magnetic end 20 of the tube 14 is to place a cylindrical cup-shaped holder 28 around the magnetic end 20 of the tube 16.

The inside diameter of the cup-shaped magnet holder 28 is greater than the outside diameter of the tube 16 at the magnet end 20. Therefore, there is provided an annular space between the two in which a pluarlity of small bar magnets 18 may be placed around the magnet end 20. Magnets 18 are aligned with the tube 16 and all are oriented in the same direction, i.e., with their north pole toward the magnetic end 20 and the south pole toward the handle end 23.

I find it convenient to machine away the outside diameter of the tube 16 at the magnet end 20 to form a shoulder 30 against which the magnets reside. This also provides an adequate annular space in which to place the magnets. The end of the annular space is sealed with epoxy 32, thus holding the magnets in place with a nonmagnetic material.

To more specifically describe my tool, I find that using a tube 16 having an outside diameter of about 17 mm and an inside diameter of about 13 mm having an overall length of about 300 mm works well. The magnetic end is machined down to a diameter of about 15 mm. It is machined down to provide an annular space of about 27 mm in length so that 12 Acnico bar magnets measuring about 4.7 mm to 4.8 mm by about 22 mm can conveniently be placed therein. This is because the holder has an inside diameter of about 25 mm, all as shown in the drawing. The driver 22 has a length from the shoulder 26 to the driving head 27 of about 340 mm so that it is about 4 cm longer than the tube 16. The driver 22 has a diameter of about 11 mm which is 2 mm less than the inside diameter of tube 16. Thus, there is about 1 mm clearance between the driver and the structure which guides it. The knurled handle 12 is about 150 mm in length and about 38 mm in diameter and is chamfered at both ends.

The magnet holder 28 is press-fitted onto the magnet end 20 of the tube 16 so that the bottom of the magnet holder is even with the shoulder 30, all as shown in the drawing.

As an aid to correlating the terms of the claims to the exemplary drawing, the following catalog of elements is provided:

| | |
|---|---|
| 10 nail | 23 handle end |
| 12 point | 24 handle |
| 14 head | 26 shoulder |
| 16 tube | 27 driving head |
| 18 magnet | 28 magnet holder |
| 20 magnet end | 30 shoulder |
| 22 driver | 32 epoxy |

The embodiment shown and described above is only exemplary. I do not claim to have invented all the parts, elements or steps described. Various modifications can be made in the construction, material, arrangement, and operation, and still be within the scope of my invention. The limits of the invention and the bounds of patent protection are measured by and defined in the following claims. The restrictive description and drawing of the specific example above do not point out what an infringement of this patent would be, but are to enable the reader to make and use the invention.

I claim as my invention:

1. A magnetic nail driver comprising:

a. a cylindrical tube made of nonmagnetic material having a handle end and a magnetic end, b. a rod-shaped driver telescoped within the tube, c. a weighted handle on the driver, the handle extending from the handle end of the tube, d. a tubular magnetic holder over the tube at the magnetic end forming e. an annular space between the magnet holder and tube, and f. a plurality of permanent bar magnets in the magnet holder, g. all said magnets aligned with the tube and oriented in the same direction.

2. The invention as defined in claim 1 wherein the magnets are held in place by epoxy resin.

3. The invention as defined in claim 1 with an additional limitation of e. the length of said driver from the weighted handle to the end which strikes the nail being greater than the length of the tube.

4. The invention as defined in claim 3 with an additional limitation of f. said driver being approximately 4 cm longer than said tube.

5. The invention as defined in claim 4 with an additional limitation of g. said handle of magnetic material and having a shoulder adjacent the rod-shaped driver so the tube may be reversed and held together magnetically for storage and transportation.

6. The invention as defined in claim 5 wherein the magnets are held in place by epoxy resin.

7. A magnetic nail driver comprising:

a. a cylindrical tube made of nonmagnetic material having a handle end and a magnetic end, b. a rod-shaped driver telescoped within the tube, c. a weighted handle on the driver, the handle extending from the handle end of the tube, d. said handle of magnetic material and having a shoulder adjacent the rod-shaped driver so the tube may be reversed and held together magnetically for storage and transportation, and e. at least one magnet on the magnetic end of the tube.

* * * * *